US006456265B1

(12) United States Patent
Mikoshiba et al.

(10) Patent No.: US 6,456,265 B1
(45) **Date of Patent: *Sep. 24, 2002**

(54) DISCHARGE DEVICE DRIVING METHOD

(75) Inventors: Shigeo Mikoshiba, Tokyo (JP); Jeong-duk Ryeom, Seoul (KR)

(73) Assignee: Samsung SDI Co., Ltd., Kyungki-Do (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/297,690

(22) PCT Filed: Jun. 13, 1997

(86) PCT No.: PCT/KR97/00112

§ 371 (c)(1),
(2), (4) Date: Aug. 3, 1999

(87) PCT Pub. No.: WO98/21706

PCT Pub. Date: May 22, 1998

(30) Foreign Application Priority Data

Nov. 8, 1996 (KR) ..... 96-52996

(51) Int. Cl.[7] ..... G09G 3/28
(52) U.S. Cl. ..... 345/66; 345/67; 345/68
(58) Field of Search ..... 345/66, 67, 68

(56) References Cited

U.S. PATENT DOCUMENTS 4,109,181 A * 8/1978 Murase et al. ..... 315/169
4,772,884 A * 9/1988 Weber et al. ..... 340/776
4,833,463 A 5/1989 Dick et al.
4,924,218 A * 5/1990 Weber et al. ..... 340/776
4,924,884 A * 5/1990 Weber et al. ..... 340/776

FOREIGN PATENT DOCUMENTS

DE 43 01 437 9/1993

* cited by examiner

*Primary Examiner*—Ulka J. Chauhan
*Assistant Examiner*—Jean Lesperance
(74) *Attorney, Agent, or Firm*—Lowe Hauptman Gilman & Berner, LLP

(57) ABSTRACT

There is provided a method for driving a discharge device, especially a plasma display panel to improve a discharge process. The discharge device driving method prevents the increase of a discharge voltage and the decrease of an operating margin since space charge is efficiently controlled to lower the discharge voltage by adding a non-discharge signal for controlling space charge to a driving signal applied to at least one of two discharge electrodes, or to a third electrode, during a discharge sustaining period of the driving signals applied to both the discharge electrodes. In particular, the effects of the present invention is markedly excellent in the case of a pulse width of 1 μs or below. Discharge can be stably sustained by using a space-charge controlling non-discharge pulse of 200 ns~1 μs wide, according to the panel structure, physical characteristics, and the driving method. In addition, in a method for applying the space-charge controlling non-discharge pulse according to the present invention, discharge efficiency can be increased by enabling the space-charge controlling non-discharge pulse to efficiently use space charge in a discharge space during a discharge sustaining period.

17 Claims, 17 Drawing Sheets

FIG. 10

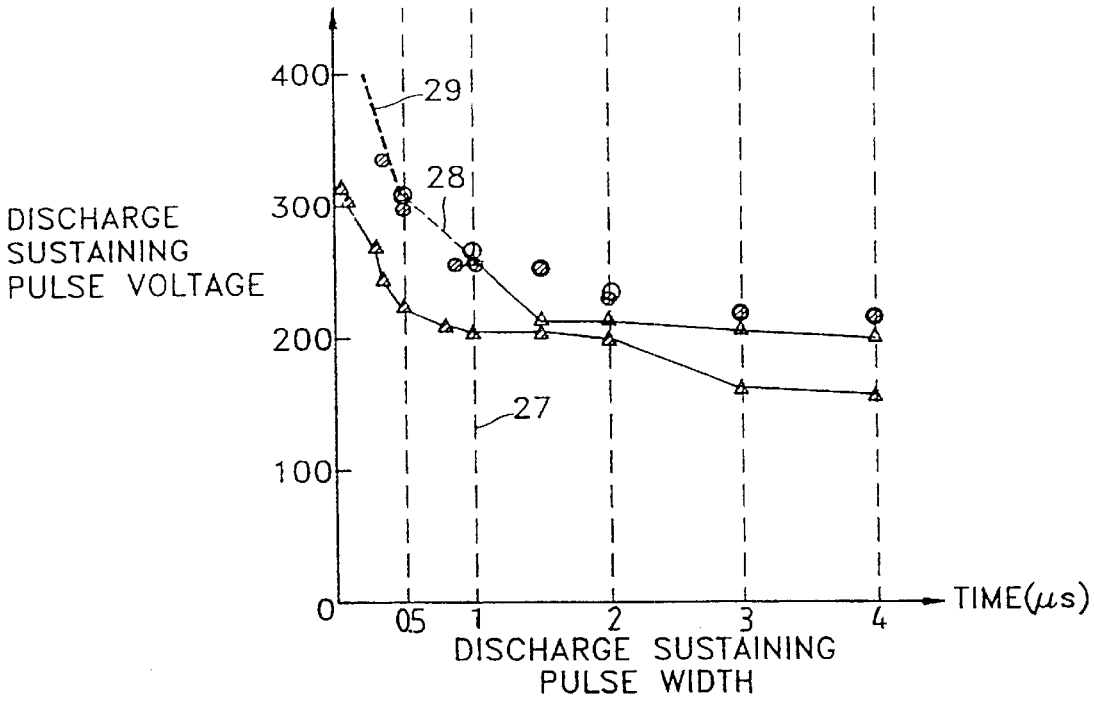

○ OVERALL DISCHARGE (WITHOUT APPLICATION SPACE-CHARGE CONTROLLING NON-DISCHARGE PULSE)

△ ADDRESS DISCHARGE (WITHOUT APPLICATION SPACE-CHARGE CONTROLLING NON-DISCHARGE PULSE)

⊘ OVERALL DISCHARGE (WITH APPLICATION SPACE-CHARGE CONTROLLING NON-DISCHARGE PULSE)

▲ ADDRESS DISCHARGE (WITH APPLICATION SPACE-CHARGE CONTROLLING NON-DISCHARGE PULSE)

- DISCHARGE SUSTAINING PULSE CYCLE:10μs
- WIDTH OF SPACE-CHARGE CONTROLLING NON-DISCHARGE PULSE:700ns

WIDTH OF SPACE-CHARE CONTROLLING NOW-DISCHARGE PULSE

- DISCHARGE SUSTAINING PULSE CYCLE:10μs, PULSE:100ns
- VOLTAGE OF SPACE-CHARGE NON-DISCHARGE PULSE:150V

DISCHARGE DEVICE DRIVING METHOD

TECHNICAL FIELD

The present invention relates to a discharge device driving method, and more particularly, to a method for improving the discharge process in a discharge device such as a plasma display panel.

BACKGROUND ART

A discharge device, which is driven by a pulse voltage, has at least one pair of electrodes and performs a discharge by applying the pulse voltage to at least one electrode. Examples of such discharge devices are a fluorescent lamp, a gas laser generator, a sulfur dioxide-removing $O_3$ generator, and a plasma display panel. Here we will focus on the discharge device of the plasm display panel.

There are generally two types of display—AC and DC. The DC plasma display panel uses electrodes exposed to a discharge space so that charges move directly between electrodes facing each other. On the other hand, in the AC plasma display panel, at least one of electrodes that face each other is surrounded by a dielectric, thereby preventing direct movement of charges between the electrodes. That is, as shown in FIG. 1A, the DC plasma display panel has a scanning electrode 2 formed on a frontal glass substrate 1 and an address electrode 5 formed on a rear glass substrate 6, which are directly exposed to a discharge space 4 so that a charge can move directly between the electrodes. The AC plasma display panel, as shown in FIG. 1B, has a scanning electrode 2 and a common electrode 3 which are covered by a dielectric layer 7, thus preventing direct charge movement between pairs of facing electrodes, that is, between the scanning electrode 2 and the address electrode 5 or between the scanning electrode 2 and the common electrode 3.

There are two methods for driving the plasma display panels as constituted above, that is, DC and AC driving methods whose classification depends on whether the polarity of a voltage applied for discharge sustainment varies with time or not. Both DC and AC driving methods can be applied to the DC plasma display panel, while only the AC driving method is available for the AC plasma display panel.

FIG. 1A illustrates a DC plasma display panel adopting a facing discharge structure, and FIG. 1B illustrates an AC plasma display panel adopting a surface discharge structure. As shown, the discharge space 4 is formed between the facing surfaces of the frontal glass substrate 1 and the rear glass substrate 6. In the DC plasma display panel, the flow of electrons supplied from the address electrode 5 (i.e., cathode) is the main energy source for sustaining discharge since the scanning electrode 2 (i.e., anode) and the address electrode 5 are directly exposed to the discharge space 4. In the AC plasma display panel, the scanning electrode 2 and the common electrode 3 are situated within the dielectric layer 7, thus being electrically isolated from the discharge space. In this case, discharge is sustained by the well-known wall charge effects. An example of the AC plasma display panel adopting the surface discharge structure is disclosed in the U.S. Pat. No. 4,833,463 by AT&T.

Depending on the constitution of electrodes for discharge, the plasma display panels are grouped into a facing discharge structure or a surface discharge structure. These structures, in turn, are divided into a two-electrode structure, a three-electrode structure, and so on to facilitate discharge. FIG. 2A illustrates a facing discharge structure, and FIG. 2B illustrates a surface discharge structure. In the facing discharge structure, address discharge for selecting a pixel and a sustainment discharge for sustaining discharge in a discharge space formed by blockheads 8 occur between the scanning electrode 2 and the address electrode 5. In the surface discharge structure, address discharge for selecting a pixel occurs between the address electrode 5 and the scanning electrode 2 which are orthogonal and face each other in the discharge space formed by the blockheads 8, and the sustainment discharge for sustaining discharge occurs between the scanning electrode 2 and the common electrode 3. The blockheads 8 act to form the discharge space and prevent crosstalk to adjacent pixels by blocking light generated during discharge.

For reliable operation of the plasma display panel as a color picture display, gray-scaling should be performed. Currently, a single field is divided into a plurality of sub-fields for time-share driving. FIG. 3 is a diagram for explaining a gray-scaling method for an AC plasma display panel applied to products, which is well-known to those skilled in the art. In the gray scale displaying method for the AC plasma display panel, a single field is divided into four sub-fields for time-share driving. Here, each sub-field has an address period 9 and a discharge sustaining period 10, and $2^4$(=16) gray scales can be displayed with these four sub-fields. That is, since the ratio of the discharge sustaining periods in a first through a fourth field is 1:2:4:8, sixteen gray scales can be attained by constituting the discharge sustaining periods as 0, 1(1T), 2(2T), 3(1T+2T), 4(4T), 5(1T+4T), 6(2T+4T), 7(1T+2T+4T), 8(8T), 9(1T+8T), 10(2T+8T), 11(3T+8T), 12(4T+8T), 13(1T+4T+8T), 14(2T+4T+8T), or 15(1T+2T+4T+8T). For example, to display a gray scale of 6 at an arbitrary pixel, only the second sub-field (2T) and the third sub-field (4T) are addressed, and to display a gray scale of 5, the first and fourth sub-fields should be addressed.

FIG. 4 shows the waveforms of signals applied to a generally used AC plasma display panel driving method, showing the timings of signals applied to an address electrode 11, a scanning electrode 12, and a common electrode 13, respectively. In an erase period 14, to -accurately display a gray scale, the operation of the next sub-field is activated by generating a weak discharge and thus a wall charge caused by the previous discharge is erased. During an address period 15, discharge occurs only in a selected area, i.e., a pixel of the whole screen in the plasma display panel by selective discharge by means of a write pulse 17 between the address electrode 5 and the scanning electrode 2 which are orthogonal to each other. That is, image information converted into an electrical signal triggers each discharge of the addressed pixels. In a discharge sustaining period 16, the image information is realized by sustaining the triggered discharge on a pixel, which is addressed on a real screen, by means of successive discharge sustaining pulses 18.

In the plasma display panel driven by the above signals, it is well-known and empirically proven that luminescent efficiency increases using shorter pulses as the discharge sustaining voltage during a discharge sustaining period when driving the plasma display panel. This is because if a narrow pulse is used as the voltage applied during the discharge sustaining period, thermal and electrical loss is reduced and thus luminescent efficiency is increased.

FIG. 5 is a diagram explaining the discharge principle of an AC plasma display panel. Here, when the discharge sustaining pulse 18 having the discharge starting voltage 20 is applied, the wall charge 24 increases and thus the discharge voltage 25 drops. In the case of a normal discharge, discharge continues until a discharge extinguishing voltage 21 is reached, thus functioning to generate sufficient wall charge and controlling the distributions of wall and space charge densities to be favorable for the next discharge. However, as the discharge sustaining pulse 18 becomes narrower, a wall charge forming period 22 becomes very short. Thus; it is difficult to generate sufficient wall charge, and worse, a space charge controlling period 23 is absent; resulting in a complete loss of control of the wall and space charges after discharge is extinguished. In this case, to continue the discharge, the discharge starting voltage 20 should be very high, which makes adjacent electrodes susceptible to discharge. Therefore, the operating margin gets smaller and it is very difficult to discharge only the addressed pixel. That is, the margin for a pulse voltage for sustaining a stable discharge becomes smaller, and is lost in the worst case. According to the U.S. Pat. No. 4,833,463 of AT&T, a negative pulse ($-V_{TC}$) is applied after an address electrode driving signal (address pulse, $+V_W/2$) during an addressing period in order to reduce the discharge starting voltage. This is for forming the wall charge near a scanning electrode as much as possible by applying the negative pulse ($-V_{TC}$) after the address pulse ($+V_W/2$) and pushing out the wall charge formed near an address electrode by the apply of the address pulse toward the scanning electrode (discharge sustaining electrode or common electrode), thereby making easy the starting of the sustaining discharge. When the negative pulse is applied to the address electrode during the addressing period as described above, the wall charge which is sufficient for the sustaining discharge can be formed near the scanning electrode even if the voltage of the address pulse applied to the address electrode is low, thereby providing an effect of lowering the voltage of the address pulse. However, since the negative voltage is applied once only during the address period, there is no method for collecting the space charges formed in a discharge space during the sustaining period. That is, the voltage of the discharge sustaining pulse applied to the scanning electrodes cannot be lowered.

There are many improvements to be made in the discharge structure and driving method of the plasma display panel. In particular, the driving voltage is higher than those of other displays due to low luminescent efficiency and discharge-dependence. Accordingly, when the driving voltage drops during driving, reliable performance of the plasma display panel cannot be expected. Furthermore, another problem arises in that the visibility of moving pictures is lowered when time share gray-scaling is displayed.

DISCLOSURE OF THE INVENTION

To overcome the above problems, the object of the present invention is to provide a discharge device driving method in which the operating margin is increased to reduce the driving voltage as a driving characteristic and, particularly, the prevention of a decrease of the operating margin caused by driving a plasma display panel by a narrow pulse.

To achieve the above object, there is provided a method for driving a discharge device which has at least a pair of electrodes and generates a discharge by applying a discharge address pulse and a discharge sustaining pulse to at least one of the pair of electrodes, the driving method comprises the step of applying a space charge controlling pulse to at least one of the electrodes during a sustaining period.

Preferably, the space charge controlling pulse is applied during a pause period of the discharge sustaining pulse, the voltage level of the space charge controlling pulse is in a range in which a self-sustained discharge caused by the voltage itself is avoided, and the pulse width of the space charge controlling pulse is between 200 nsec–1 $\mu$sec.

In the present invention, preferably, the discharge device comprises: a pair of electrodes in parallel for generating a sustainment discharge by alternately applying discharge sustaining pulses of the same polarity; and a third electrode orthogonal to the pair of electrodes, for generating an address discharge in cooperation with at least one of the pair of electrodes upon application of a discharge address pulse. Preferably, the space charge controlling pulse is applied to the third electrode during the pause period of the discharge sustaining pulse, or to at least one of the pair of parallel electrodes during the pause period of the discharge sustaining pulse, or to the pair of parallel electrodes and the third electrode. It is preferable that the space charge controlling pulse has a polarity which is the same as or opposite to that of the discharge sustaining pulse.

Also, preferably, the method for driving the discharge device in which the pair of parallel electrodes are covered with an insulation layer and the polarity of the discharge sustaining pulse varies with time, comprises the steps of: addressing a discharge by applying the discharge address pulse to the third electrode and thus selecting an intended pixel; and sustaining the discharge by applying the discharge sustaining pulse to at least one of the pair of parallel electrodes and thus maintaining luminescence of the selected pixel, wherein the discharge addressing step is temporally independent of the discharge sustaining step, and the discharge sustaining period includes repeated discharge sustaining pulses and discharge pause periods.

Also, preferably, the discharge device has a pair of parallel electrodes for generating a sustainment discharge by alternately applying discharge sustaining pulses of the same polarity. Preferably, the space charge controlling pulse having the same polarity as or the opposite polarity to that of the discharge sustaining pulse voltage is applied to the other electrode immediately after the discharge sustaining pulse applied to one of the pair of electrodes is terminated. Also, in the present invention, preferably, the discharge device has a pair of electrodes, to one of which a positive discharge sustaining pulse is applied and to the other of which a negative discharge sustaining pulse is applied. Preferably, the method for driving the drive device comprises the steps of: addressing a discharge by applying the discharge address pulse to at least one electrode of the paired electrodes and thus selecting an intended pixel; and sustaining the discharge by applying the discharge sustaining pulse to at least one of the pair of crossing electrodes and thus displaying the selected pixel luminescently, wherein the discharge addressing step is temporally independent of the discharge sustaining step, and the discharge sustaining period includes repeated discharge sustaining pulses and discharge pause periods.

Also, in the method for driving the discharge device of the present invention, preferably, a discharge sustaining pulse is applied only to one electrode of the pair of electrodes. Here, the discharge sustaining pulse has positive and negative polarities, alternately, and the space charge controlling pulse having a polarity opposite to that of the discharge sustaining pulse is applied to the other electrode immediately after the discharge sustaining pulse is applied. Also, as an alternative, one of the pair of electrodes is at 0V, the discharge sustaining pulse having positive and negative polarities is applied to the other electrode, and the space charge controlling pulse having the same polarity as that of the discharge sustaining pulse is applied after the discharge sustaining pulse.

BRIEF DESCRIPTION OF THE DRAWINGS

FIG. 10 is a linear diagram showing variations of a discharge sustaining voltage with the width of a discharge sustaining pulse in a test to which the signals of FIG. 9 are applied;

BEST MODE FOR CARRYING OUT THE INVENTION

The discharge device driving method of the present invention pertains mainly to a discharge device driven by a pulse voltage and, particularly, to the application of a space-charge controlling nondischarge pulse during a discharge pause period assigned between two consecutive discharges in a discharge sustaining period of a plasma display panel.

Figure 6:
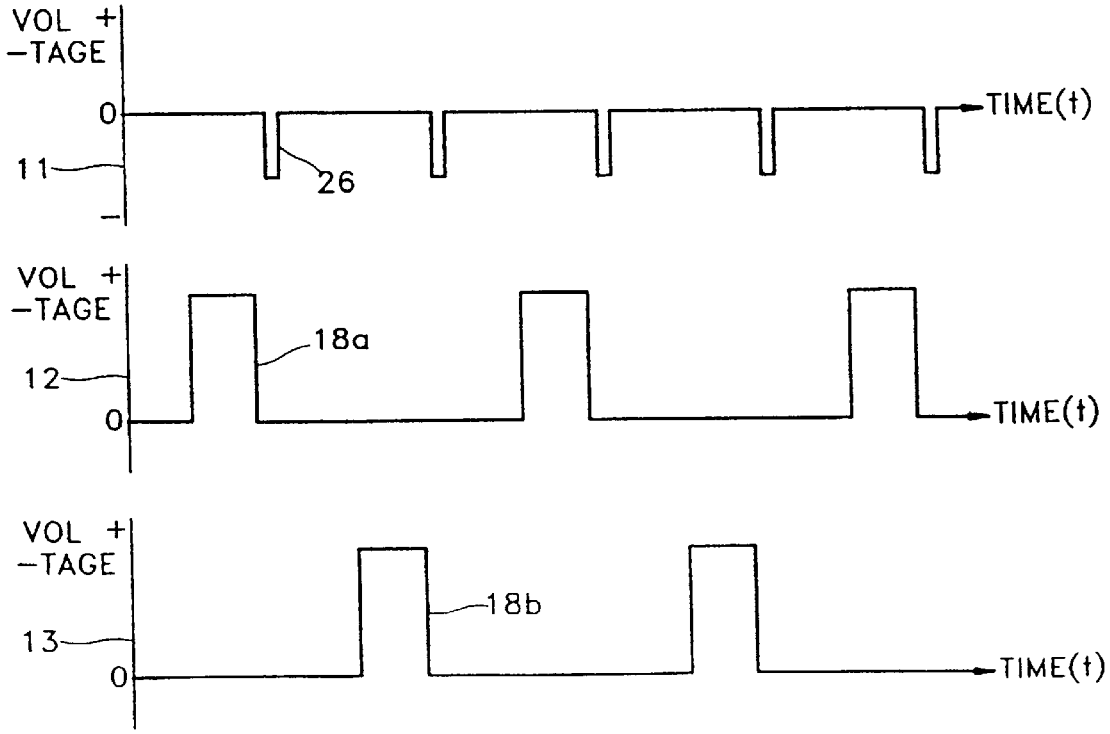
FIG. 6 illustrates the waveforms of signals applied to electrodes to drive a plasma display panel as a discharge device according to a first embodiment of a driving method of the present invention.

FIG. 6 illustrates the waveforms of driving signals showing a method for generating a sustainment discharge in a discharge device according to the present invention. As shown, the main characteristic of the sustainment discharge driving lies in the addition of a space-charge controlling non-discharge pulse 26 to conform to the discharge pause period assigned between the discharge sustaining pulses 18*a* and 18*b* of both the scanning electrode signal 12 and the common electrode signal respectively applied to the main electrodes 2 and 3 for generating the sustainment discharge.

Figure 7:
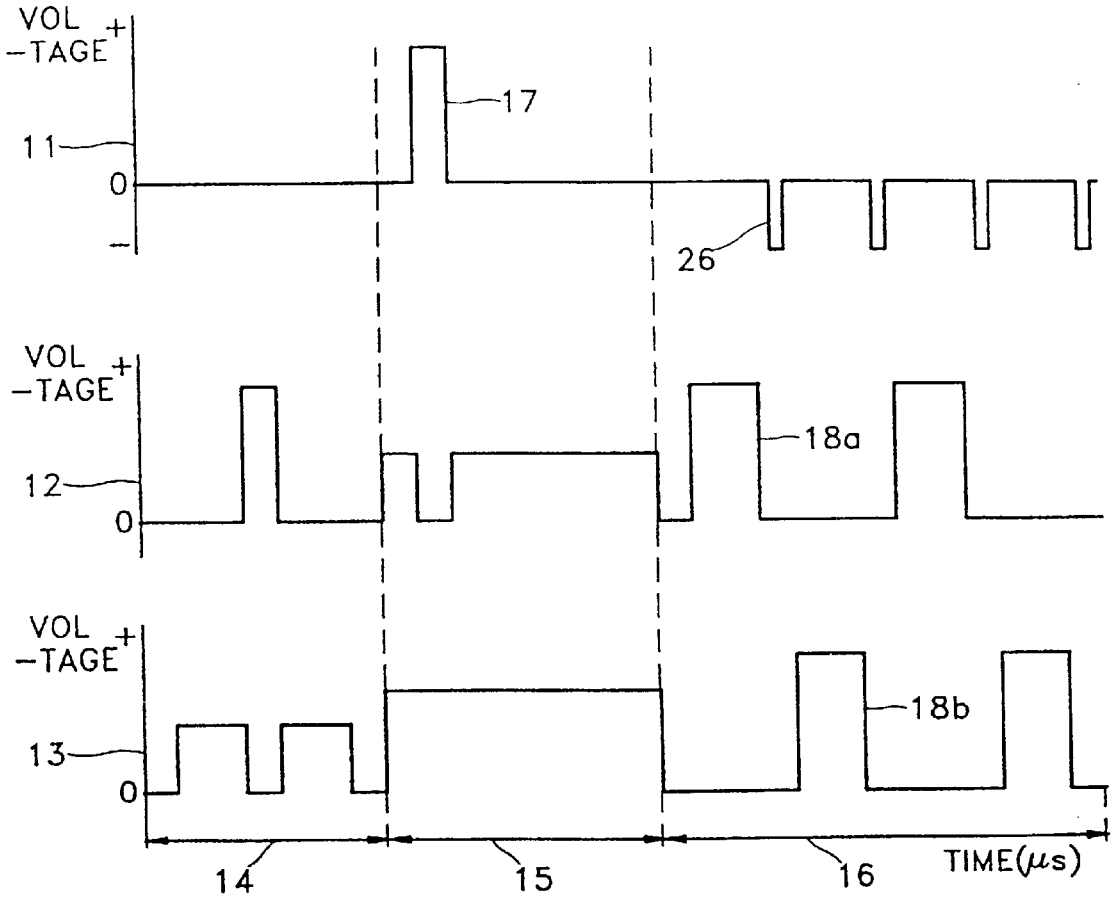
FIG. 7 illustrates the waveforms of the signals shown in FIG. 6 applied to an AC plasma display panel according to a first embodiment of the present invention.

FIG. 7 illustrates the waveforms of electrode driving signals applied to an AC plasma display panel according to a first embodiment of the present invention. The electrode driving signals of FIG. 7 are perfect in that the signal waveforms during an erase period 14 and an address period 15 are combined with the electrode driving signals waveforms during the sustainment discharge period of FIG. 6. As described above, the drive timing of the AC plasma display panel is generally comprised of the erase period 14 for erasing remaining charge, the address period for selecting an arbitrary pixel, and a discharge sustaining period 16 for maintaining luminescence. In particular, the discharge device is driven by adding the space-charge controlling non-discharge pulse 26 to the address electrode signal 11 during the discharge sustaining period for display-luminescence such that a discharge starting voltage is lowered in control of space charge in a discharge space. Accordingly, discharge can be sustained at a lower voltage. For this purpose, a negative pulse is applied as the space-charge controlling non-discharge pulse 26 to the address electrode signal 11 immediately after both discharge sustaining pulses 18*a* and 18*b* of the scanning electrode signal 12 and the common electrode signal 13, and its cycle coincide with those of both the discharge sustaining pulses 18*a* and 18*b*. Thus, the space charge caused by discharge generated by the scanning electrode signal 12 and the common electrode signal 13 can be controlled.

Figure 8A:
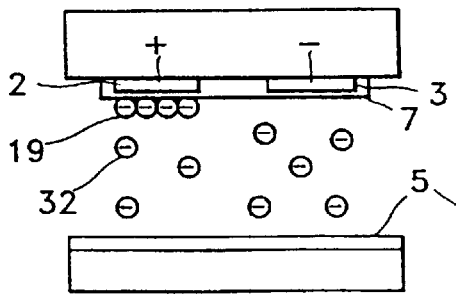
FIG. 8A illustrates a distribution of space charge when the signals of FIG. 4 are applied to the AC plasma display panel.
Figure 8B:
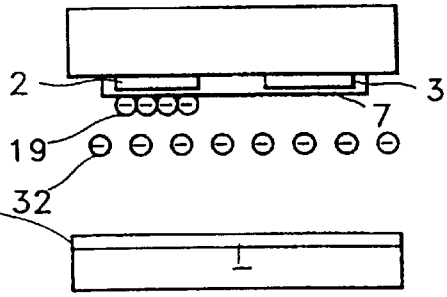
FIG. 8B illustrates a distribution of space charge when the signals of FIG. 7 are applied to the AC plasma display panel.

FIGS. 8A and 8B illustrate distributions of space charge in the AC plasma display panel. FIG. 8A shows the space charge distribution shortly after discharge between the scanning electrode 2 and the common electrode 3. In this case, the wall charge 19 is produced on an electrode which was positive during discharge and the remaining charged particles exist randomly as space charge 32 in the discharge space. The disorder level of the space charge 32 increases with time, and the space charge 32 is extinguished by diffusion and recombination. FIG. 8B shows the space charge distribution when the space-charge controlling non-discharge pulse 26 lower than a discharge starting voltage is applied to the address electrode shortly after discharge occurs between the scanning electrode 2 and the common electrode 3. In this case, the space charge 32 still remaining in the discharge space obtains kinetic energy by an electric field produced by the non-discharge pulse 26. Part of the space charge 32 collides with the scanning electrode or common electrode, thus increasing the wall charge, and part of the space charge gathers around the canning and common electrodes, thus increasing space charge density and thus electric conductivity around both electrodes. As a result, the discharge starting voltage drops and discharge is sustained at a relatively low voltage. Here, since the voltage level of the space-charge controlling non-discharge pulse 26 is low, a new self-sustained discharge caused by application of this pulse voltage never occurs.

To find out what impact the non-discharge pulse 26 imposes as described above, the driving signals of the first embodiment were applied to an AC three-electrode surface discharging plasma display panel currently on the market.

Figure 9:
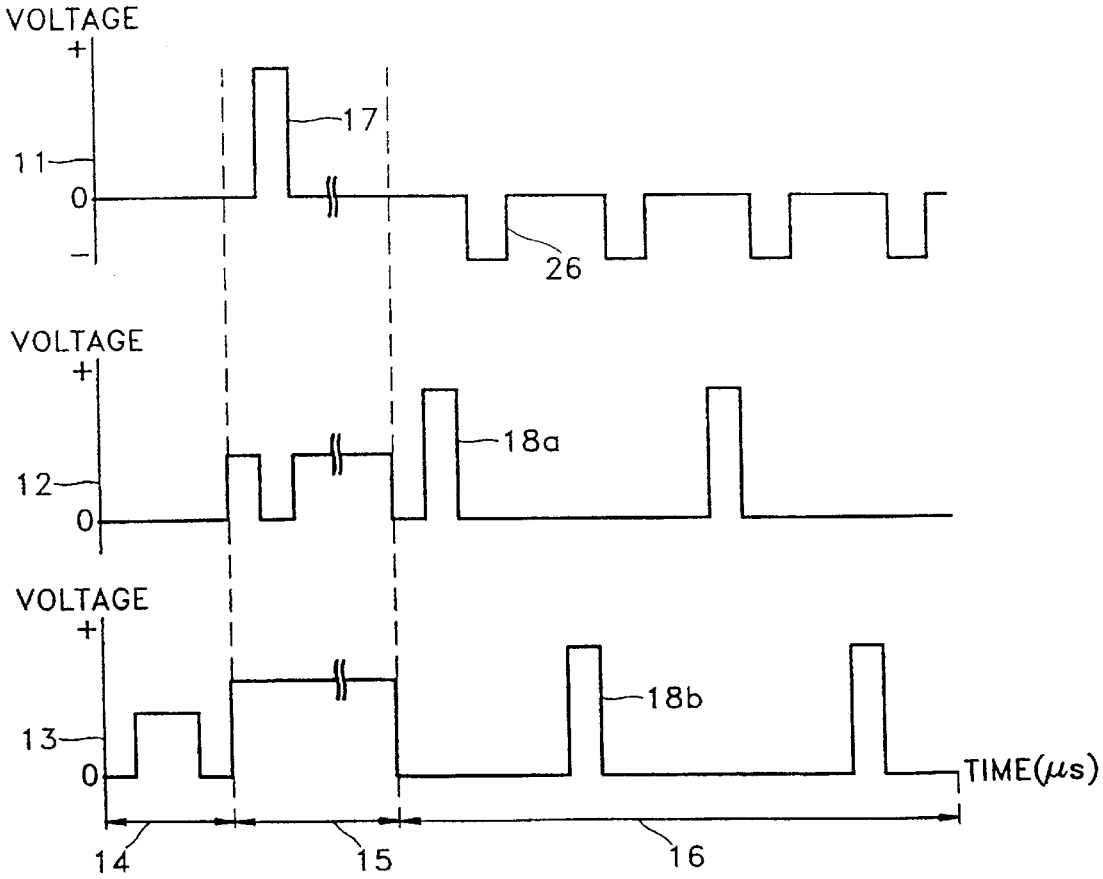
FIG. 9 illustrates the waveforms of signals applied to a test of the plasma display panel driving method of the present invention.

FIG. 9 is a timing diagram of the driving signals of the first embodiment used in an actual test. A discharge is generated at a pixel, for which a discharge will be triggered, by applying a 3.5 μs pulse to the address electrode 5 during the address period 15, and wall charge is accumulated for triggering the discharge. During this period, the scanning electrode is at 0V, and a voltage of 100–190V is applied to the common electrode 3 so that wall charge accumulation effects are improved to stabilize the next discharge. During the discharge sustaining period 16, a predetermined positive voltage is applied alternately to the scanning electrode 2 and the common electrode 3, and the negative space-charge controlling non-discharge pulse 26 is applied to the address electrode 5 between the discharge sustaining pulses 18*a* and 18*b* applied respectively to the scanning electrode 2 and the common electrode 3, that is, during the discharge pause. In practice, the space-charge controlling non-discharge pulse 26 was applied about 40 ns after application of the discharge sustaining pulses 18*a* and 18*b*. The voltage of the negative space-charge controlling non-discharge pulse 26 is controlled to stabilize the discharge between 50–150V. Voltages at which the discharge is stabilized with and without the space-charge controlling non-discharge pulse were measured by varying the width of the discharge sustaining pulses 18*a* and 18*b* in the range between 90 ns and 4 μs. Here, stabilizing the discharge indicates that all the pixels in a display pixel group having several tens of pixels are stably illuminated without flickering. In addition, discharge stabilities were measured by varying the width of the space-charge controlling non-discharge pulse 26 in the range between 100 ns and 1.5 μs, the results were estimated, and the effects of the present invention were verified.

FIG. 10 illustrates the relationship between the width [μs] and voltage [V] of the discharge sustaining pulse according to the application of a space charge controlling pulse as a result of the test in which the non-discharge pulse of the first embodiment is applied.

TABLE 1 variation of discharge sustaining voltage with width of discharge sustaining pulse

| width of discharge sustaining pulse [μs] | overall discharge voltage [V] (without application of SCCP) | address discharge voltage [V] (without application of SCCP) | overall discharge voltage (with application of SCCP) | address discharge voltage [V] (with application of SCCP) |
|---|---|---|---|---|
| 4 | 230 | 210 | 230 | 170 |
| 3 | 237 | 223 | 237 | 175 |
| 2 | 254 | 226 | 243 | 207 |
| 1.5 | 254 | 235 | 251 | 214 |
| 1 | 269 | 257 | 254 | 215 |
| 0.85 | not measured | not measured | 258 | 218 |
| 0.5 | 312 | 312 | 292 | 238 |
| 0.35 | not measured | not measured | 340 | 247 |
| 0.2 | 340 or above | impossible | 340 or above | 280 |
| 0.1 | 340 or above | impossibte | 340 or above | 317 |
| 0.09 | 340 or above | impossible | 340 or above | 323 |

Here, ○ represents the overall luminescent voltage which makes addressing impossible without applying the space-charge controlling non-discharge pulse, and ● represents the overall luminescent voltage which makes addressing impossible applying the space-charge controlling non-discharge pulse 26. Δ represents a discharge sustaining voltage which makes addressing possible without applying the space-charge controlling non-discharge pulse 26, and ▲ denotes a discharge sustaining voltage which makes addressing possible applying the space-charge controlling non-discharge pulse. From the test results, it is noted that the discharge sustaining voltage is lower with the application of the space-charge controlling non-discharge pulse 26 than without application of the space-charge controlling non-discharge pulse 26. In particular, with a pulse width of 1 μs as a boundary 27, an overall discharge and an address discharge exist together when the space-charge controlling non-discharge pulse 26 in the case of a pulse width less than 1 μs, thus losing an addressing function as indicated by reference numeral 28. In case of a discharge sustaining pulse width less than 0.5 μs, addressing is impossible and thus overall luminescence is immediately performed as indicated by reference numeral 29. However, when the space charge controlling pulse is applied, a stable address discharge sustaining function was performed within measured limits. If the pulse width of the discharge voltage is large enough, the wall charge is sufficiently accumulated while the discharge sustaining pulse is applied, thereby automatically bringing the discharge to a halt. In this case, the space-charge controlling non-discharge pulse functions to control density distribution of space charge to influence diffusion and extinguishing of the space charge, increase the existence of the space charge until the next discharge, and thus increase electric conductivity to facilitate the next discharge.

If the pulse width of the discharge voltage is too small, the voltages of the discharge sustaining pulses 18*a* and 18*b* become zero before the discharge automatically stops after the start of the discharge. Thus, the discharge is forcibly stopped. In this case, a large amount of space charge remains. Under these circumstances, when the non-discharge pulse for controlling space discharge is applied, wall charge formation and control of charge density are markedly effected by the space-charge controlling non-discharge pulse.

Since there is a small difference between the presence and absence of the space charge controlling pulse, it can be inferred that the non-discharge pulse has a local, not global, influence on the discharge characteristics of the plasma display panel.

Figure 11:
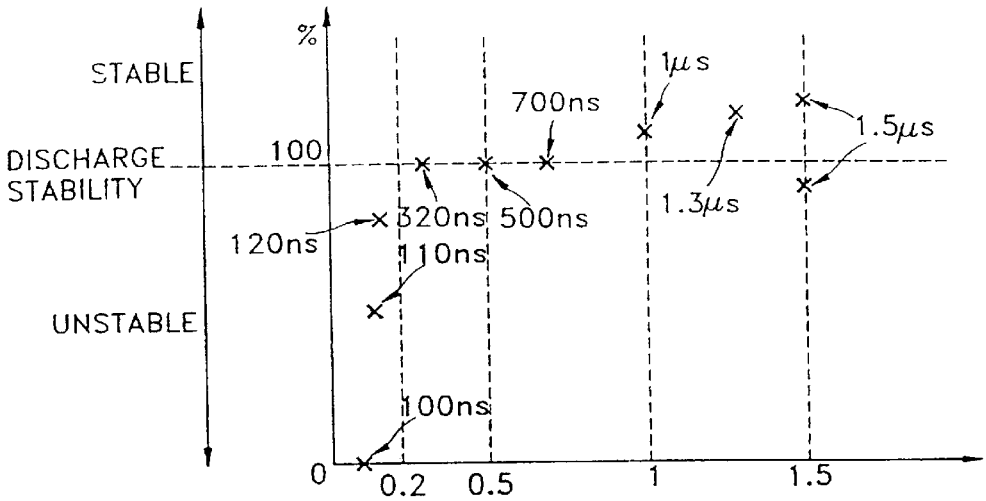
FIG. 11 is a linear diagram showing variations of a discharge stability with the width of a space-charge controlling non-discharge pulse in the test to which the signals of FIG. 9 are applied.

FIG. 11 illustrates the relationship between the width [μs] of the space-charge controlling non-discharge pulse and the stability of discharge. Here, discharge stability is defined as a rate of the number of flickering unstable pixels in a single pixel group having several tens of pixels. That is, the highest level of stability is achieved when 100% of the pixels are luminescent stably. From a test result, discharge is most stabile with the width of the non-discharge pulse between 300–700 ns. With the pulse width of 300 ns or less, the discharge is likely to be extinguished, and with the pulse width of 700 ns or more, overdischarge may cause unstable discharge.

As described above, a discharge sustaining voltage is lowered during a discharge, especially with a pulse width of 1 μs or less, by efficiently controlling space charge in a discharge space to be supplied to a discharge electrode. In addition, discharge is stably sustained at a width 30 of about 200 ns–1 μs depending on the panel structure, physical characteristics, and the driving method.

Figure 1A:
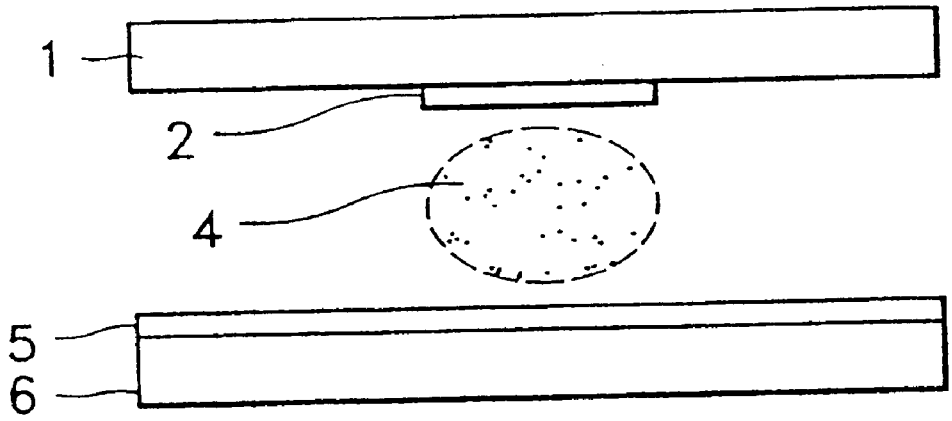
FIG. 1A is a sectional view of a general DC plasma display panel as a discharge device.
Figure 1B:
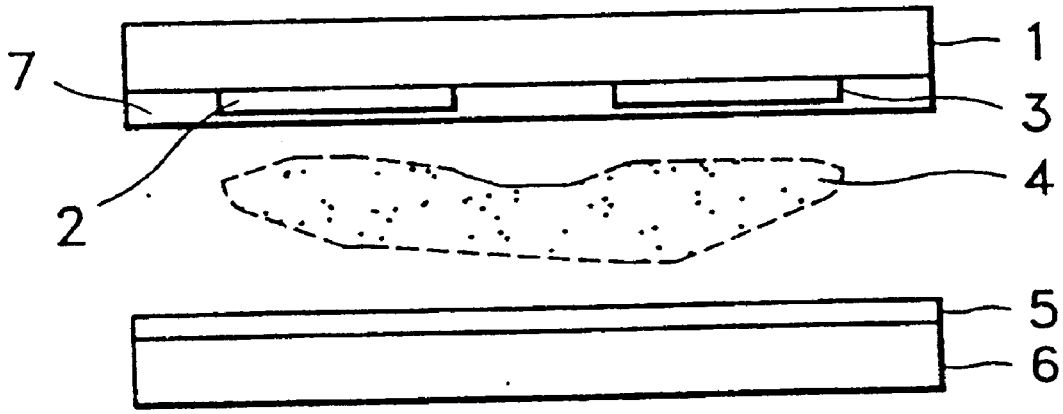
FIG. 1B is a sectional view of a general AC plasma display panel as a discharge device.
Figure 2A:
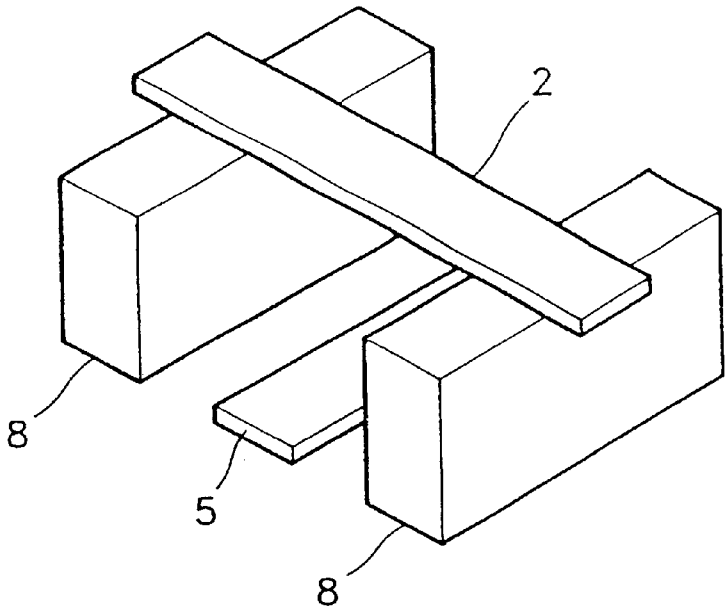
FIG. 2A is an extracted perspective view of a plasma display device of a two-electrode facing discharge structure.
Figure 2B:
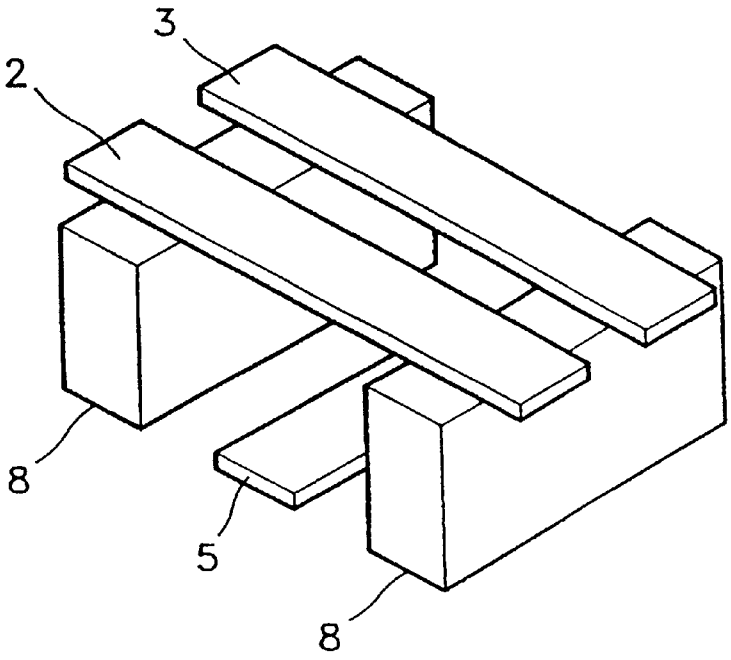
FIG. 2B is an extracted perspective view of a plasma display panel of a three-electrode surface discharge structure.
Figure 3:
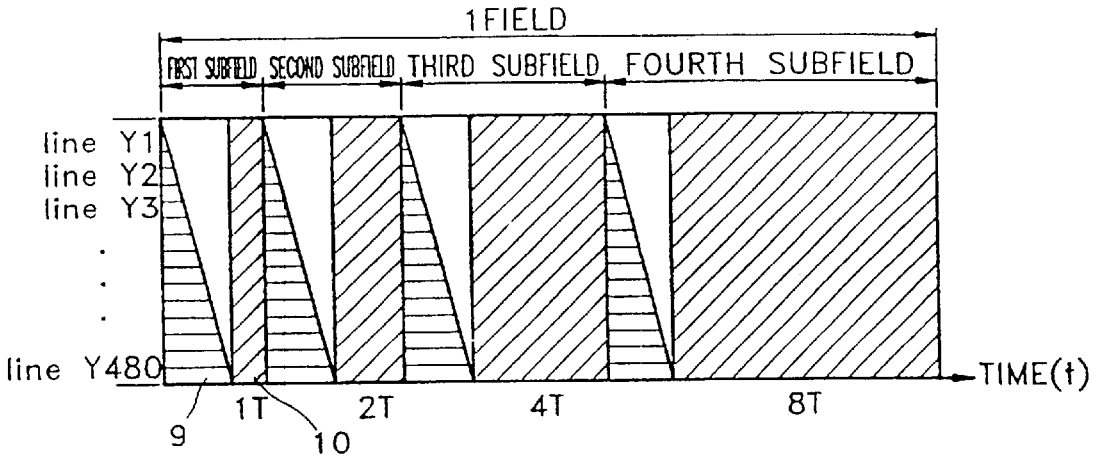
FIG. 3 is an explanatory diagram of a gray scale displaying method for the general AC plasma display panel.
Figure 4:
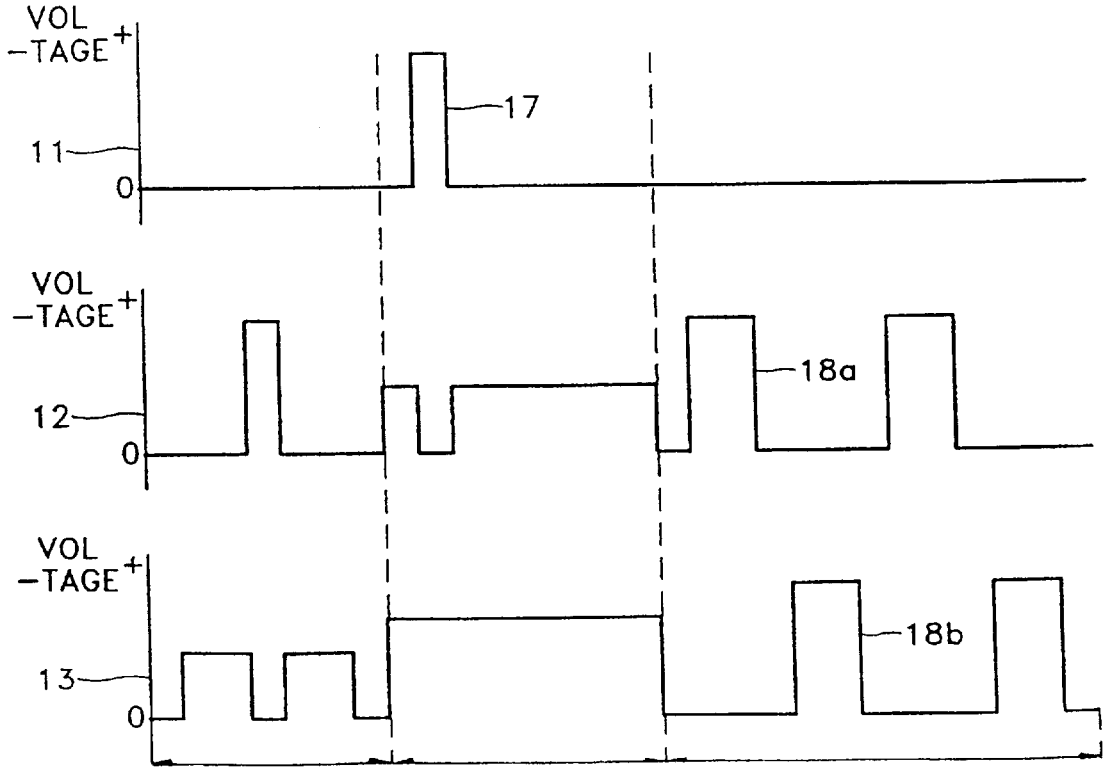
FIG. 4 illustrates the waveforms of general signals applied to electrodes to drive the AC plasma display panel.
Figure 5:
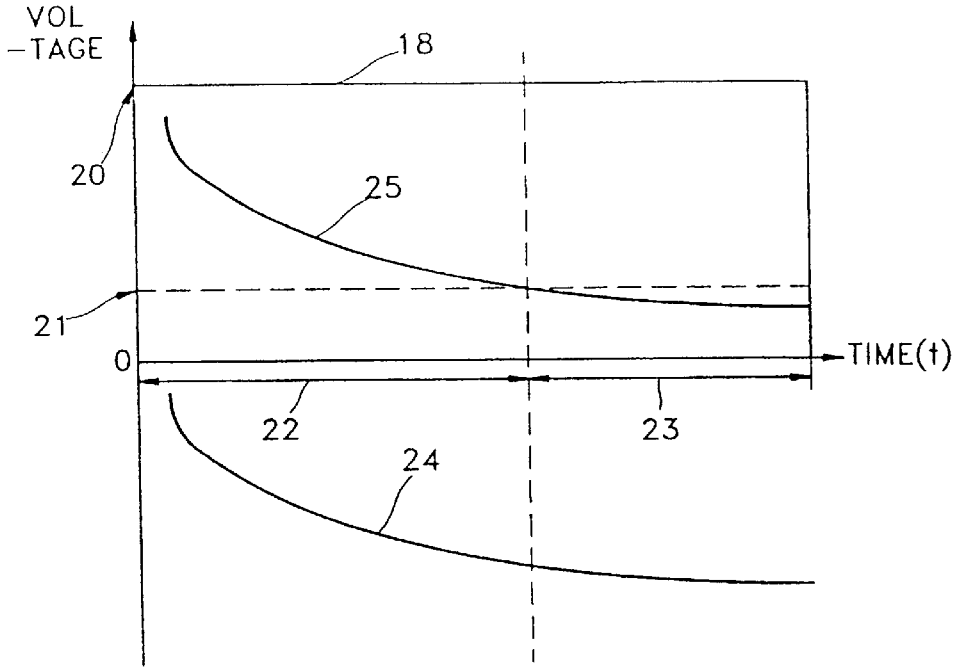
FIG. 5 is an explanatory diagram of the discharge principle of the AC plasma display panel.
Figure 12:
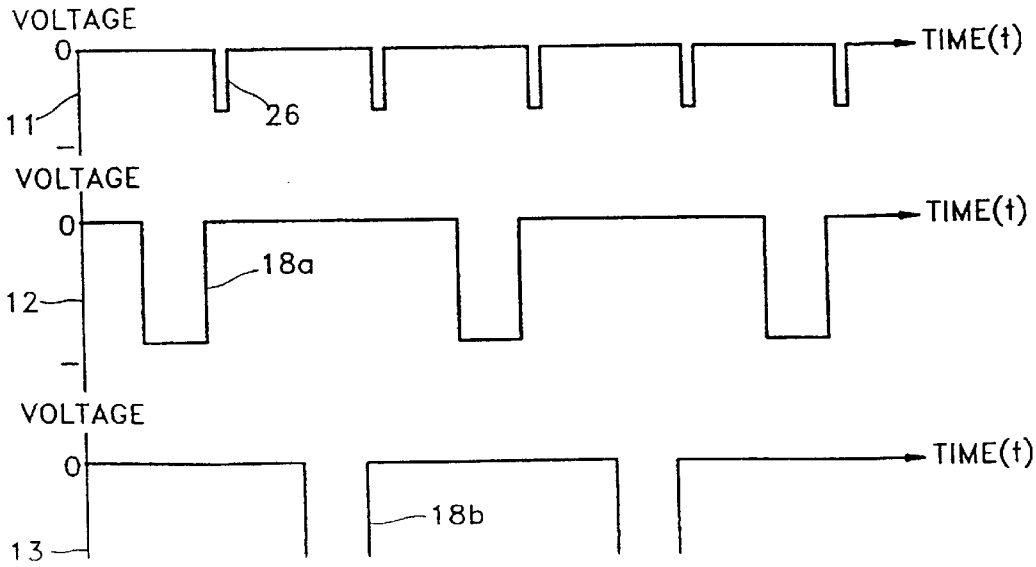
FIG. 12 illustrates the waveforms of driving signals according to a second embodiment.
Figure 13:
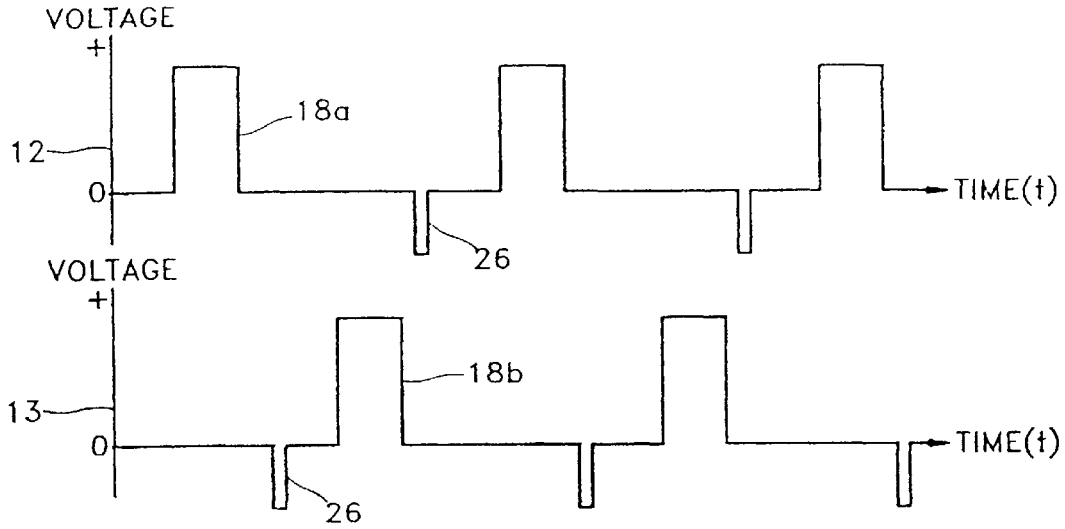
FIG. 13 illustrates the waveforms of driving signals according to a third embodiment.
Figure 14:
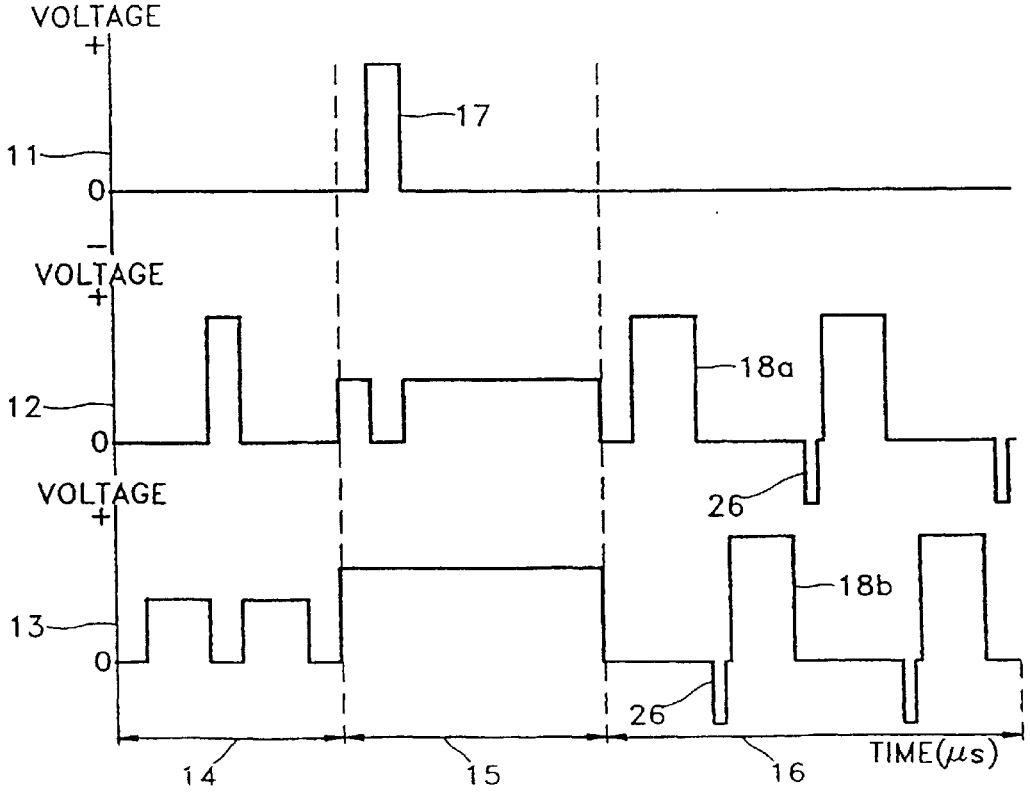
FIG. 14 illustrates the waveforms of perfect driving signals of the AC plasma display panel to which the third embodiment of FIG. 13.

Meanwhile, as shown in FIG. 12, the space-charge controlling non-discharge pulse can be applied even though the discharge sustaining pulses of a scanning electrode signal 12 and a common electrode signal 13 are negative (–) in a second embodiment of the present invention. In this case, the above space charge control effects can be achieved even with the application of the negative space-charge controlling non-discharge pulse 26 as the address electrode signal 11. As shown in FIG. 13, the space-charge controlling non-discharge pulse 26 may be added to the scanning electrode signal 12 and the common electrode signal 13, alternately, instead of the address electrode signal, according to a third embodiment of the present invention. Here, the space-charge controlling non-discharge pulse 26 is added to the electrode signal to which the discharge sustaining pulses 18*a* and 18*b* are not applied, during a pause period of a discharge sustaining pulse. In the third embodiment, the loss of the address electrode 5 caused by ion collision encountered in the first embodiment of FIG. 1 can be prevented. FIG. 14 illustrates the waveforms of perfect driving signals of the AC plasma display panel to which the third embodiment of FIG. 13 is applied.

Figure 15:
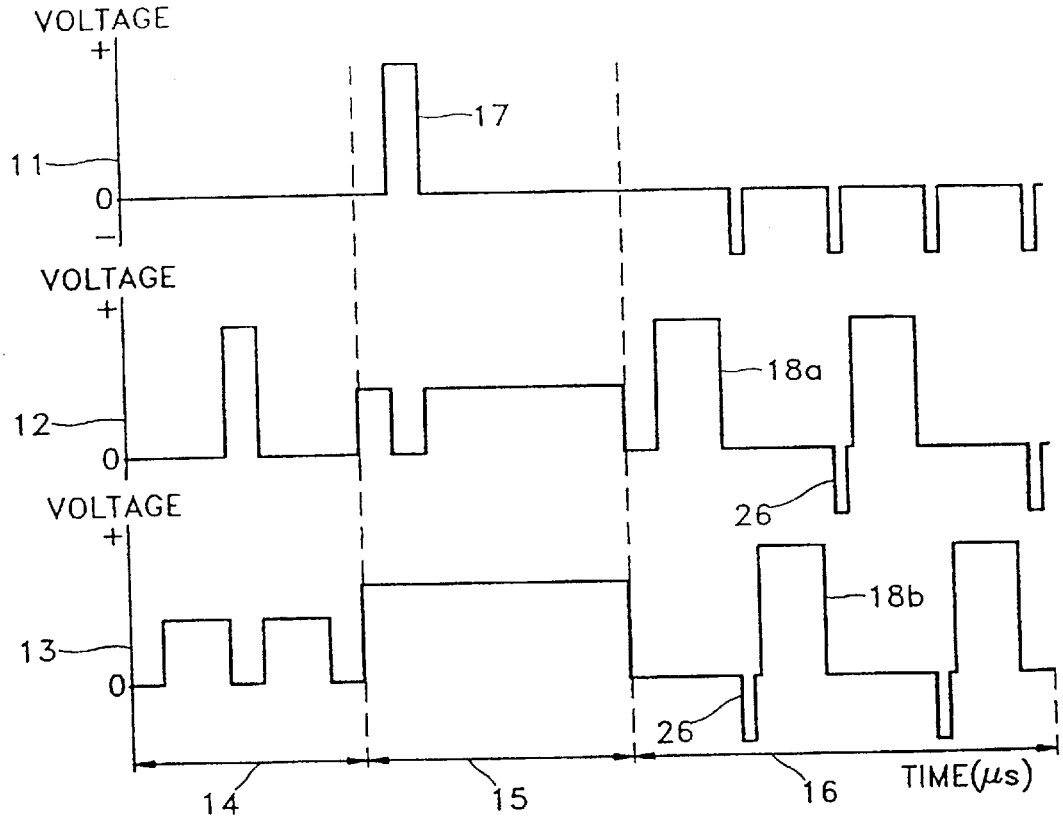
FIG. 15 illustrates the waveforms of driving signals according to a fourth embodiment.
Figure 16:
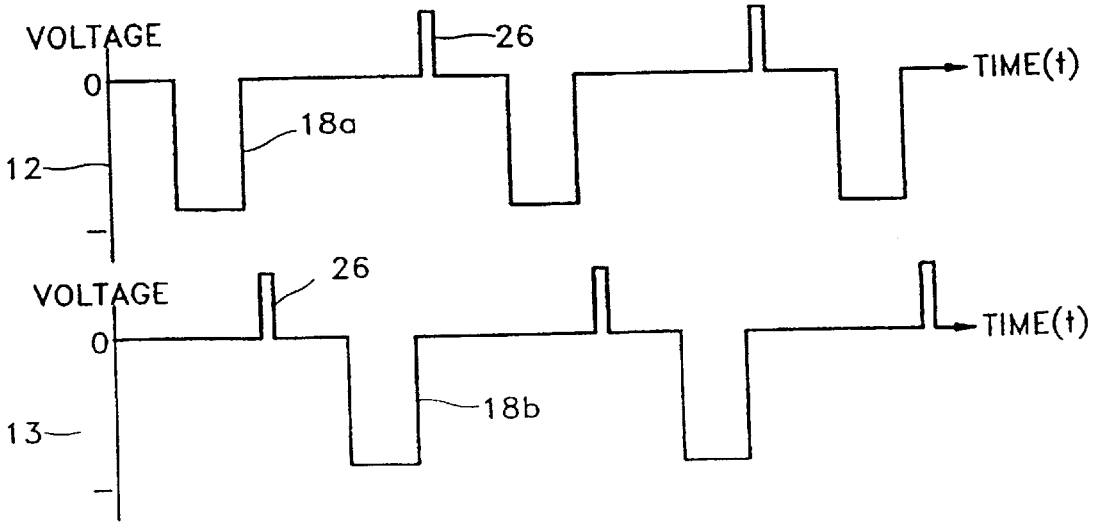
FIG. 16 illustrates the waveforms of driving signals according to a fifth embodiment.
Figure 17:
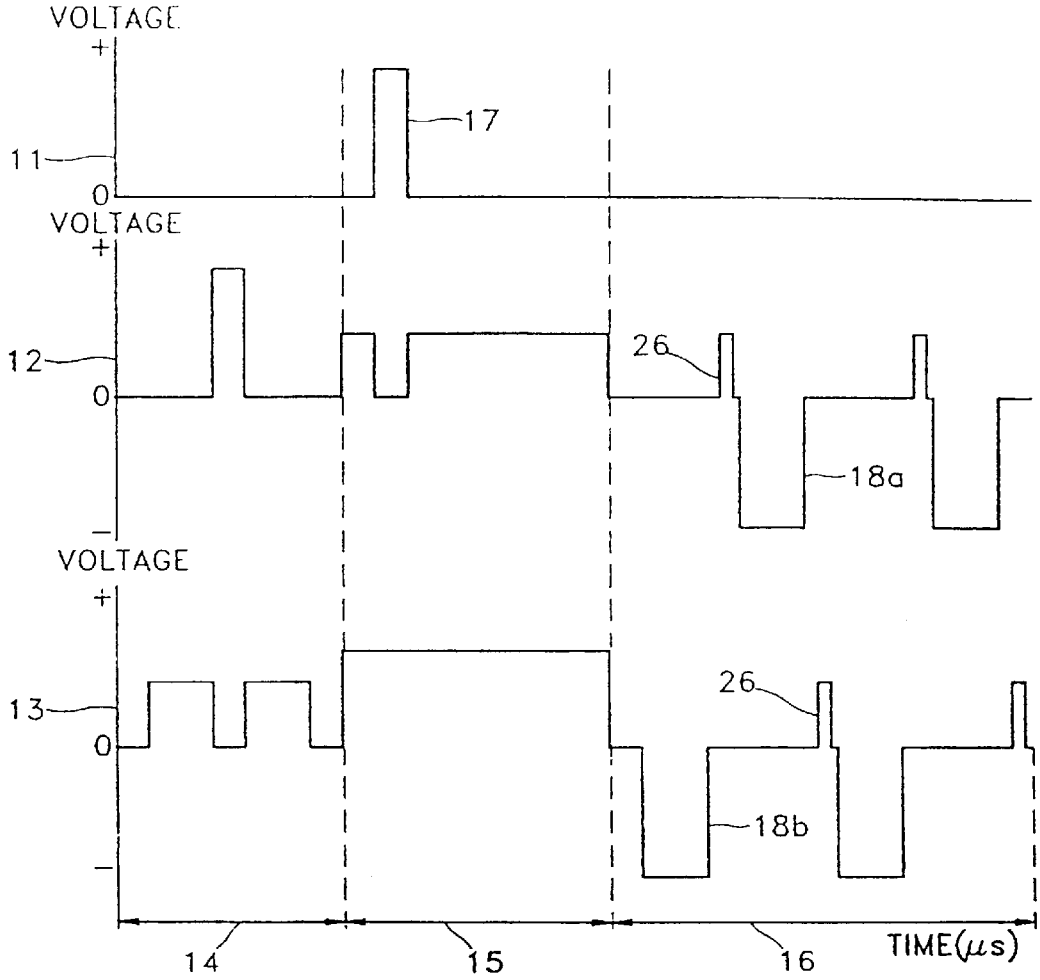
FIG. 17 illustrates the waveforms of perfect driving signals of the AC plasma display panel to which the fifth embodiment of FIG. 16 is applied.

As shown in FIG. 15, to increase the utilization efficiency of the space charge, the space-charge controlling non-discharge pulse 26 may be applied to the address electrode 5, and the discharge electrodes 2 and 3 according to a fourth embodiment. As shown in FIG. 16, a positive non-discharge pulse 26 for controlling this method can be applied to the discharge electrodes 2 and 3 with negative discharge sustaining pulses 18*a* and 18*b* according to a fifth embodiment by modifying the fourth embodiment. The fifth embodiment also shows the advantage of preventing the loss of the address electrode 5 caused by ion collision. FIG. 17 illustrates the perfect waveforms of driving signals when the fifth embodiment of FIG. 16 is applied to a real AC plasma display panel.

Figure 18:
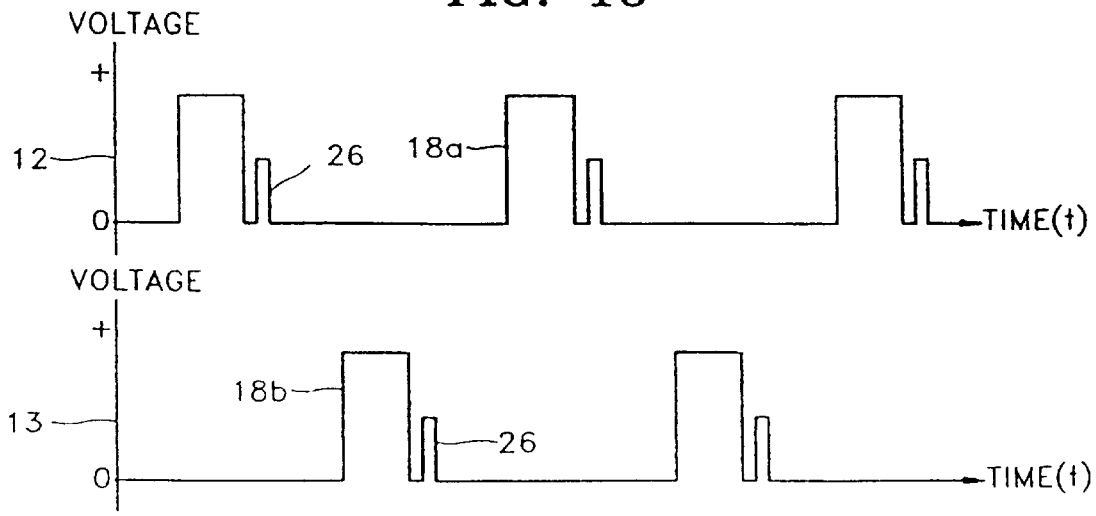
FIG. 18 illustrates the waveforms of driving signals according to a sixth embodiment.
Figure 19:
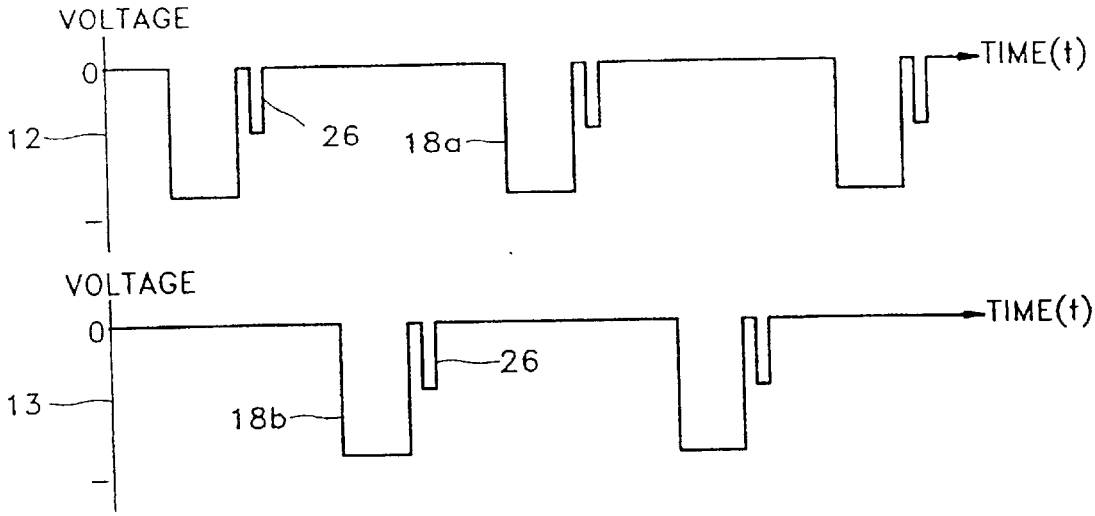
FIG. 19 illustrates the waveforms of driving signals according to a seventh embodiment.
Figure 20:
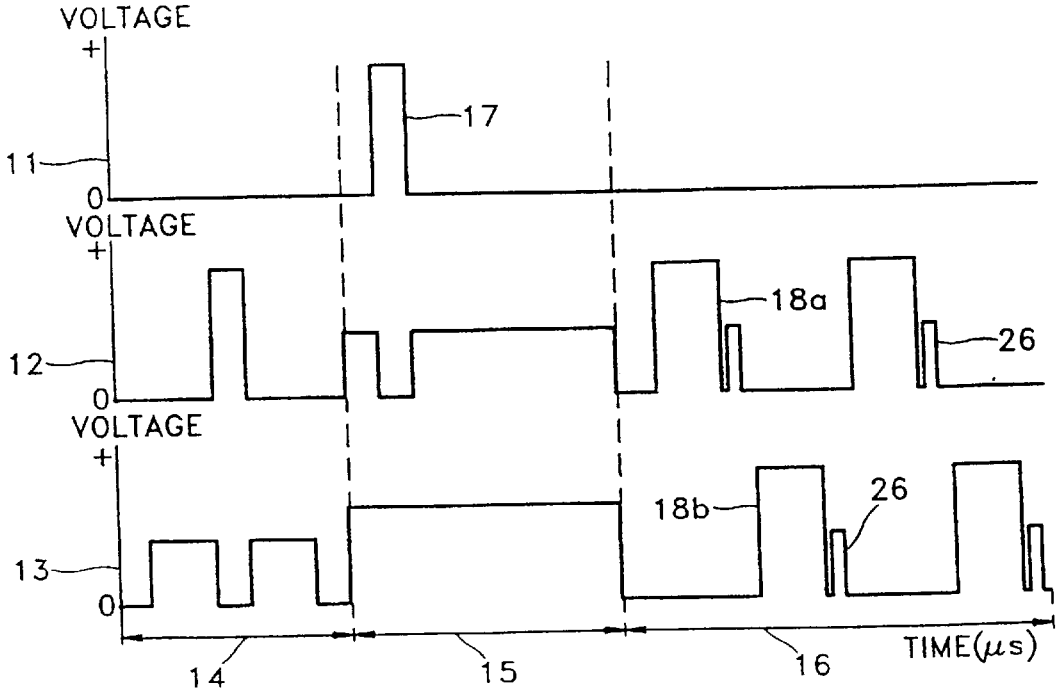
FIG. 20 illustrates the perfect waveforms of real driving signals when the method of the sixth embodiment is applied to the AC plasma display panel.
Figure 21:
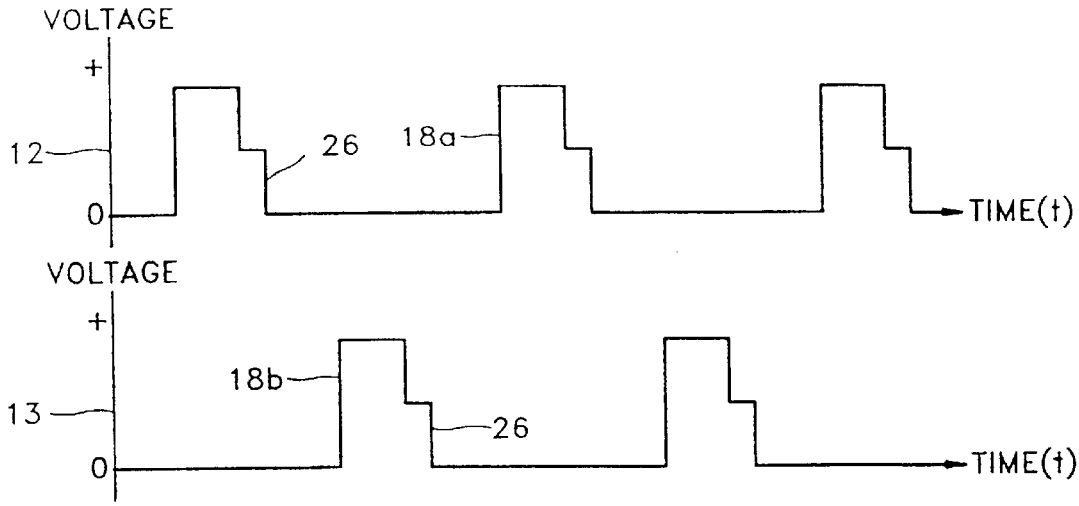
FIG. 21 illustrates the waveforms of driving signals according to an eighth embodiment.
Figure 22:
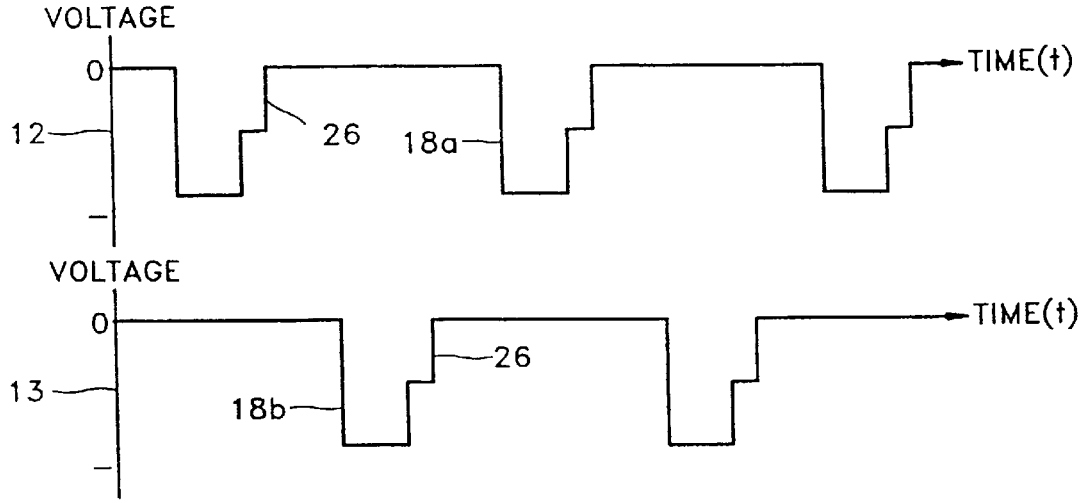
FIG. 22 illustrates the waveforms of driving signals according to a ninth embodiment.
Figure 23:
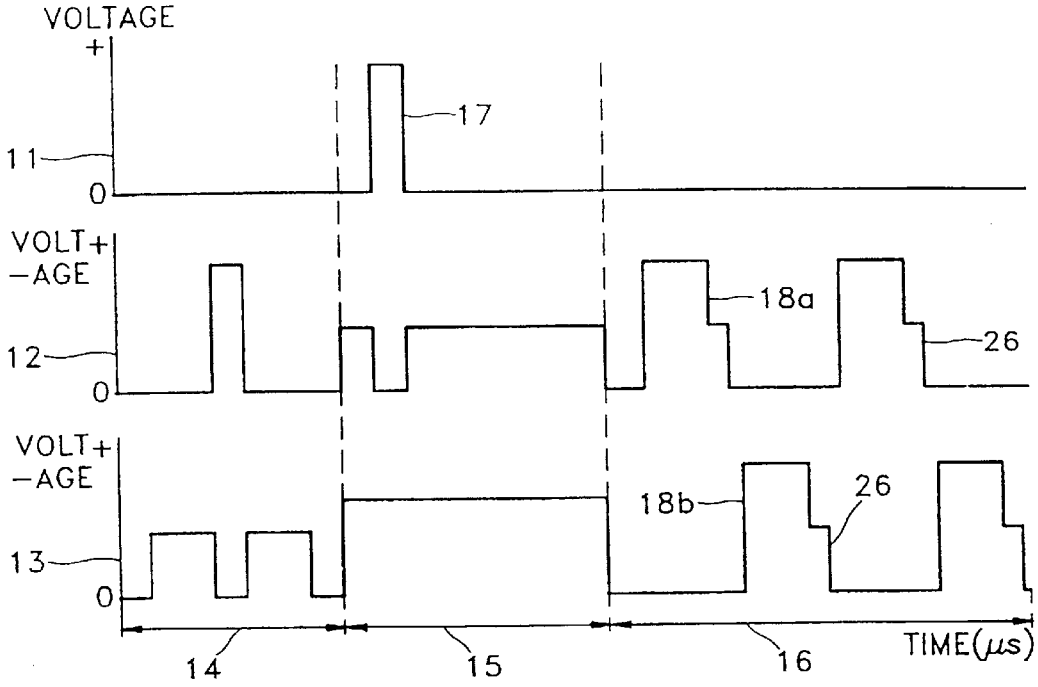
FIG. 23 illustrates the waveforms of perfect driving signals when the discharge period signals of the eight embodiment are applied to a real AC plasma display panel.
Figure 24:
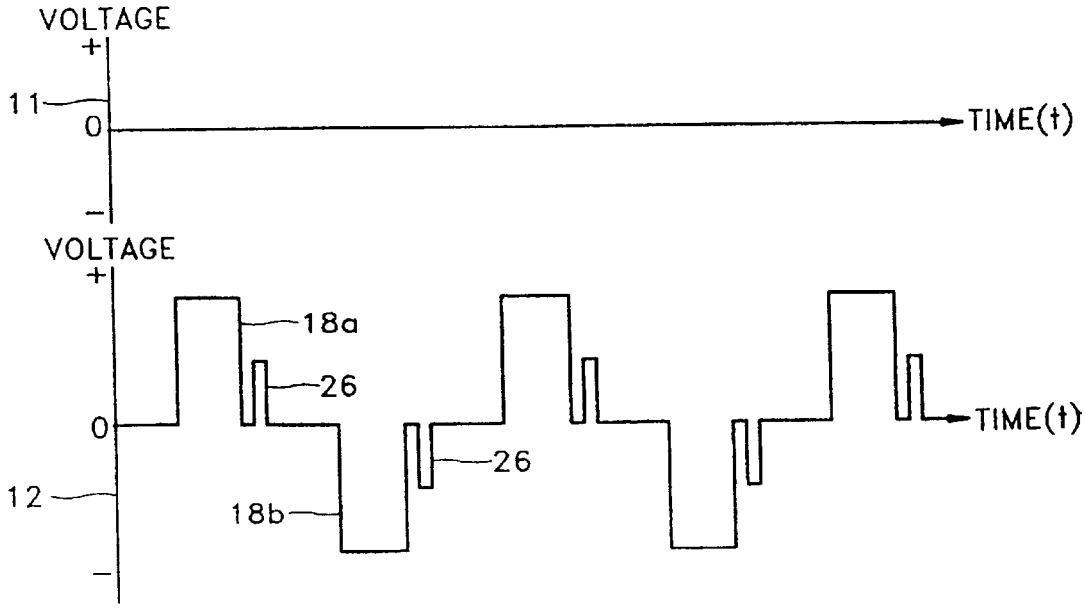
FIG. 24 illustrates the waveforms of driving signals according to a tenth embodiment.
Figure 25:
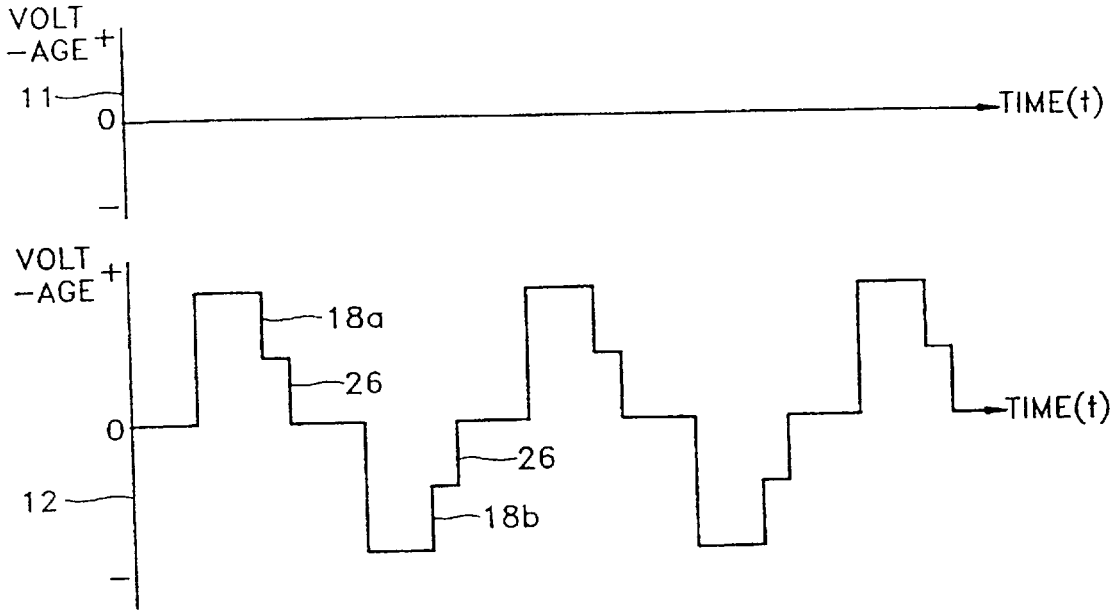
FIG. 25 illustrates the waveforms of driving signals according to an eleventh embodiment.

As shown in FIGS. 18 and 19, the space charge controlling pulse 26 having the same polarity as those of the discharge sustaining pulses 18*a* and 18*b* to the main electrodes 2 and 3 for sustaining a discharge, after the discharge pulses 18*a* and 18*b* according to sixth and seventh embodiments. These methods can relieve circuitry burdens resulting from application of negative and positive voltages to a single electrode. FIG. 20 illustrates the perfect waveforns of real driving signals when the method of the sixth embodiment is applied to the AC plasma display panel. FIGS. 21 and 22 illustrate the space-charge controlling non-discharge pulse 26 integrally added immediately after the discharge pulses 18*a* and 18*b* according to eighth and ninth embodiments. FIG. 23 illustrates the waveforms of perfect driving signals when a discharge period signal is applied to the real AC plasma display panel. According to a tenth embodiment of the present invention, driving signals can be constituted as shown in FIG. 24. In this method, the address electrode signal 11 is at 0V, and a discharge is sustained by applying a positive discharge pulse and a negative discharge pulse to a discharge electrode, i.e., a scanning electrode. Further, the space charge control effects of the present invention can be achieved by applying the space-charge controlling non-discharge pulse 26 having the same polarity as that of the discharge pulse during a pause period of the discharge pulse. FIG. 25 illustrates the waveforms of driving signals for a plasma display panel in which a discharge pulse 18 is integrated with the space-charge controlling non-discharge pulse 26 to facilitate generation of pulses applied to the tenth embodiment in terms of circuitry, according to an eleventh embodiment.

Figure 26:
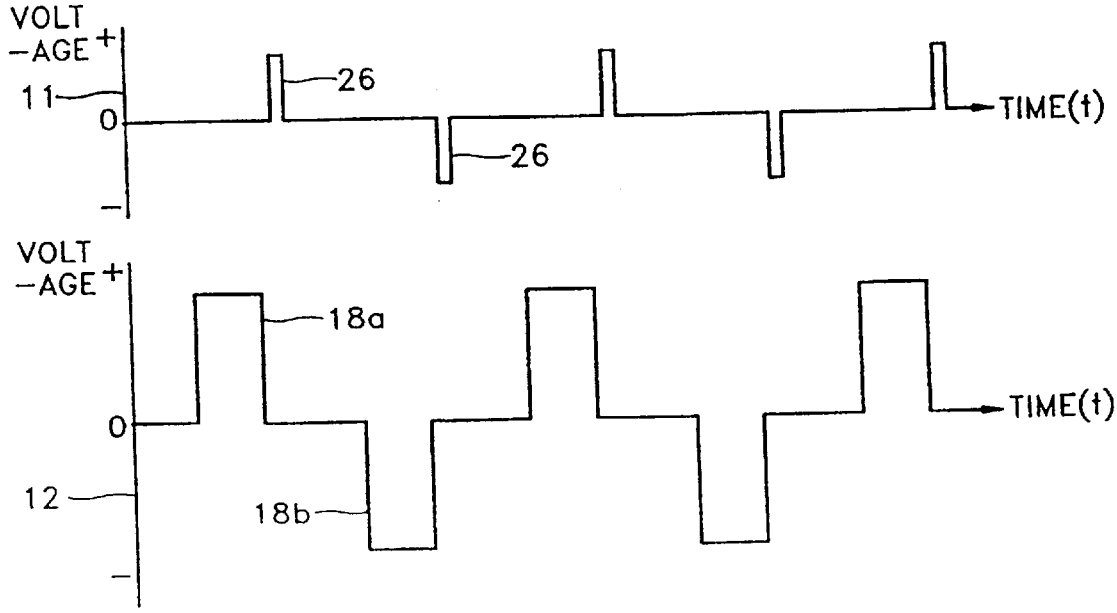
FIG. 26 illustrates the waveforms of driving signals according to a twelfth embodiment.

FIG. 26 illustrates the waveforms of driving signals of a plasma display panel in which the positive and negative discharge pulses 18*a* and 18*b* are alternately applied to an electrode, for example, the scanning electrode 2, and non-discharge pulses 26*a* and 26*b* having opposite polarities for controlling space charge are applied to another electrode, i.e., an address electrode, immediately after the discharge pulses 18*a* and 18*b*, according to a twelfth embodiment.

Figure 27:
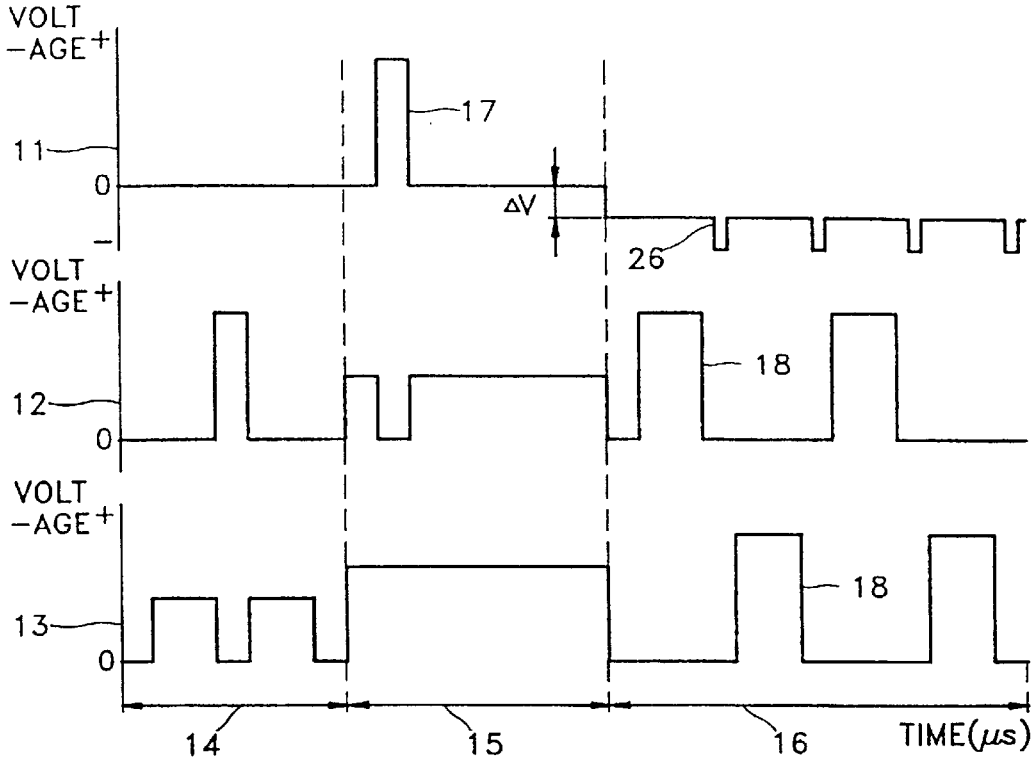
FIG. 27 illustrates the waveforms of driving signals according to a thirteenth embodiment.

FIG. 27 illustrates the waveforms of driving signals in which a predetermined negative voltage ΔV is applied during the discharge period of the address electrode signal 11 and the space-charge controlling non-discharge pulse 26 is added thereto, according to a thirteenth embodiment. This driving method relatively lowers the non-discharge pulse 26 for controlling space charge, thus preventing leakage of a discharge current from the address electrode 5.

Figure 28:
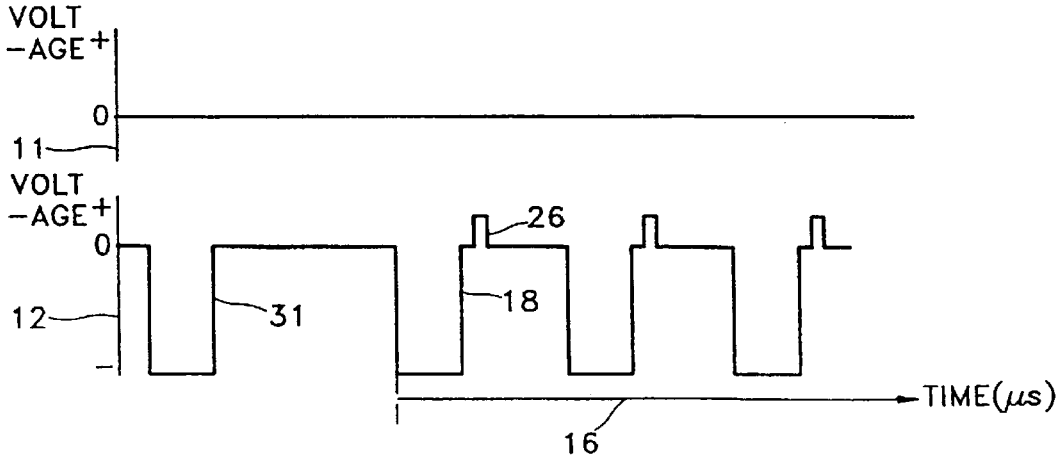
FIG. 28 illustrates the waveforms of driving signals according to a fourteenth embodiment.
Figure 29:
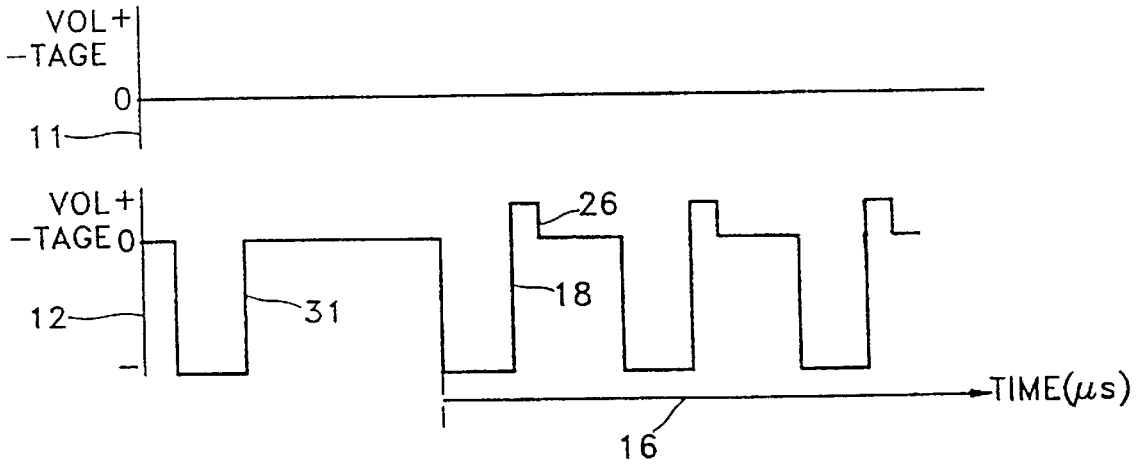
FIG. 29 illustrates the waveforms of driving signals according to a fifteenth embodiment.

FIG. 28 illustrates the waveforms of driving signals when the space-charge controlling non-discharge pulse 26 to a DC plasma display panel having the address electrode 5 and the scanning electrode 2 according to a fourteenth embodiment. This method can also control space charge by adding the non-discharge pulse 26 for controlling space discharge, which has a polarity opposite to a discharge pulse during the discharge period 16 of the scanning electrode signal 12. FIG. 29 illustrates the space-charge controlling non-discharge pulse 26 integrated with the discharge sustaining pulse 18 to facilitate generation of pulses of driving signals of the fourteenth embodiment in terms of circuitry according to a fifteenth embodiment.

INDUSTRIAL APPLICABILITY

As described above, the method for driving a discharge device, especially a plasma display panel, prevents the increase of the discharge voltage and a decrease of the operating margin since space charge is efficiently controlled to lower the discharge sustaining voltage by adding a non-discharge signal for controlling space charge to a driving signal applied to at least one of two discharge electrodes, or to a third electrode, during a discharge sustaining period of the driving signals applied to both the discharge electrodes. Accordingly, the method for driving a plasma display panel of the present invention provides an effect of improving the increase of the discharge sustaining voltage and the decrease of the operating margin, which could not be achieved by U.S. Pat. No. 4,833,463 of AT&T. In particular, the effects of the present invention is remarkably excellent in the case of a pulse width of 1 $\mu$s or below. Discharge can be stably sustained by using a space-charge controlling non-discharge pulse of 200 ns~1 $\mu$s wide, according to the panel structure, physical characteristics, and the driving method. In addition, in a method for applying the space-charge controlling non-discharge pulse according to the present invention, discharge efficiency can be increased by enabling the space-charge controlling non-discharge pulse to efficiently use space charge in a discharge space during a discharge sustaining period.

What is claimed is:

1. A method of driving a discharge device having at least a pair of electrodes, said driving method comprising the steps of:

addressing a discharge by applying a discharge address pulse, during an addressing period, and sustaining the discharge by applying at least one discharge sustaining pulse, during a sustaining period, to at least one of said electrodes; and applying a space charge controlling pulse to at least one of said electrodes during said sustaining period;

wherein the space charge controlling pulse is applied during a pause period of said at least one discharge sustaining pulse; and the voltage level of said space charge controlling pulse is in a range in which a self-sustained discharge caused by the voltage itself is avoided.

2. A method of driving a discharge device having first and second electrodes disposed in parallel and a third electrode disposed transverse to said first and second electrodes, said driving method comprising the steps of:

addressing a discharge by applying a discharge address pulse, during an addressing period, to said third electrode;

sustaining the discharge by alternately applying a plurality of discharge sustaining pulses of the same polarity, during a sustaining period subsequent to the addressing period, to said first and second electrodes; and applying at least one space charge controlling pulse to at least one of said first, second and third electrodes during said sustaining period;

wherein the space charge controlling pulse is applied during a pause period between successive said discharge sustaining pulses.

3. The method of claim 2, wherein said space charge controlling pulse is applied to said third electrode.

4. The method of claim 2, wherein said space charge controlling pulse is applied to at least one of said first and second electrodes.

5. The method of claim 4, wherein said space charge controlling pulse has the same polarity as the discharge sustaining pulses, and is applied to one of the first and second electrodes immediately after one of the discharge sustaining pulses is applied thereto.

6. The method of claim 5, wherein one of the discharge sustaining pulses and said space charge controlling pulse are concurrent in time and a voltage level of said space charge controlling pulse is added to a voltage level of said discharge sustaining pulse.

7. The method of claim 4, wherein said space charge controlling pulse has a polarity opposite to that of the discharge sustaining pulses, and is applied to one of the first and second electrodes immediately after one of the discharge sustaining pulses is applied to the other of the first and second electrodes.

8. The method of claim 2, wherein said at least one space charge controlling pulse is applied to all of said first, second and third electrodes.

9. The method of claim 8, wherein the space charge controlling pulse to be applied to one of the first and second electrodes is applied immediately after one of said discharge sustaining pulses is applied to said one of the first and second electrodes, and has the same polarity as the discharge sustaining pulses.

10. The method of claim 9, wherein one of the discharge sustaining pulse and said space charge controlling pulse are concurrent in time and a voltage level of said space charge controlling pulse is added to a voltage level of said discharge sustaining pulse.

11. The method of claim 8, wherein the space charge controlling pulse to be applied to one of the first and second electrodes is applied immediately after one of said discharge sustaining pulses is applied to the other of the first and second electrodes, and has a polarity opposite to that of the discharge sustaining pulses.

12. The method of claim 2, wherein said first and second electrodes are covered with an insulation layer and the polarity of said discharge sustaining pulses varies with time.

13. The method of claim 2, wherein said addressing step is temporally independent of said sustaining step.

14. A method of driving a discharge device having at least first and second electrodes, said driving method comprising the steps of:

addressing a discharge by applying a discharge address pulse, during an addressing period, and sustaining the discharge by applying a plurality of discharge sustaining pulses, during a sustaining period, to at least one of said first and second electrodes; and applying at least one space charge controlling pulse to at least one of said first and second electrodes during said sustaining period;

wherein said space charge controlling pulse is applied during a pause period between successive said discharge sustaining pulses; and the discharge sustaining pulses are applied only to the first electrode.

15. The method of claim 14, wherein the discharge sustaining pulses have positive and negative polarities, alternately, and said at least one space charge controlling pulse is applied to the second electrode immediately after one of the discharge sustaining pulses is applied to the first electrode, and has a polarity opposite to that of said discharge sustaining pulse.

16. The method of claim 14, wherein the second electrode is kept at 0V, and said at least one space charge controlling pulse is applied to the first electrode immediately after one of the discharge sustaining pulses is applied thereto, and has the same polarity as said discharge sustaining pulse.

17. The method of claim 14, wherein one of the discharge sustaining pulses is concurrent in time with said space charge controlling pulse, and a voltage level of said space charge controlling pulse is added to a voltage level of said discharge sustaining pulse.

* * * * *